United States Patent [19]

Grimes

[11] 3,966,111

[45] June 29, 1976

[54] CONTAINER PARTITIONING

[75] Inventor: Brian A. Grimes, Warwick, R.I.

[73] Assignee: Grimes Box Company, Inc., East Providence, R.I.

[22] Filed: Oct. 20, 1975

[21] Appl. No.: 624,175

[52] U.S. Cl. ..... 229/15; 217/31; 217/22; 229/42

[51] Int. Cl.[2] ..... B65D 5/48; B65D 81/00

[58] Field of Search ..... 229/15, 42; 217/22, 217/31

[56] References Cited

UNITED STATES PATENTS

| | | | |
|---|---|---|---|
| 2,675,167 | 4/1954 | Deline et al. | 229/42 |
| 3,343,742 | 9/1967 | Siegler | 229/15 |
| 3,511,404 | 5/1970 | Pearson | 217/31 |
| 3,767,106 | 10/1973 | Morgan | 229/15 |

*Primary Examiner*—Davis T. Moorhead
*Attorney, Agent, or Firm*—Salter & Michaelson

[57] ABSTRACT

Partitioning for a container having sets of spaced parallel panels that are interconnected with each other to delineate in conjunction with the container a plurality of four sided cells within the container for receipt and protective transport of articles deposited therein. The individual panels of each set of panels include an intermediate body section and a plurality of projections extending upwardly and downwardly therefrom so as to form alternating projections and cutouts on either side thereof, wherein the upwardly and downwardly extending projections of each panel are laterally offset from each other. The panels of each set are also formed with slots that extend from a panel side and that terminate within an intermediate body portion thereof for aligned engagement when the panels of respective sets are interconnected with each other. The slots of one set of panels are further disposed so as to extend upwardly through each downwardly extending projection thereof so as to enable the adjacent placement of such downwardly extending projections at the bottom corners of each article receiving cell to better protect the article base portions from damaging contact with each other. The partition is also designed for placement within the container in an alternative reversed position so that the adjacent cell corner projections are disposed uppermost.

6 Claims, 6 Drawing Figures

CONTAINER PARTITIONING

BACKGROUND OF THE INVENTION

Interfitted panel constructions which form partitions for containers are well-known. Conventionally, such panels are formed from a solid rectangular blank wherein slots provided therein enable the respective transverse and longitudinal interconnection thereof. However, the prior known panel construction was wasteful of blank material, and accordingly partitioning incorporating panels having cutouts on either side thereof for producing a greater number of panels has been developed. U.S. Pat. No. 3,767,106 issued Oct. 23, 1973, represents such an improved panel construction enabling more efficient material usage. Although the improved panel provided for maximum material usage, this construction was deficient in providing overall protection of the articles as located in the individual cells that were formed when such panels were interlocked together. That is, the upwardly extending projections of each panel were positioned in a spaced relationship about the upper periphery of each cell, and thus could not prevent articles received in contiguous cells from coming in contact with each other. This was particularly true in the prior known containers where the base portions of such articles were not cylindrical but eliptical and thus extended from corner to corner. It has also been found that identically placed slots of such panelling configuration unnecessarily weakened the immediate body portion thereof by reason of their extension from the cutout portion therein.

It would accordingly be desirable to have available a partition construction having panel configurations which provide for maximum blank material usage and which also interfit to form cell structures having different configurations at either end thereof so as to accommodate a greater variety of article shapes therein. It is further desirable to provide panel constructions which are not substantially weakened by the slots formed therein.

SUMMARY OF THE INVENTION

The present invention accomplishes the stated aims while avoiding the indicated prior art shortcomings by the provision of a container partition having a first set of panels of a first configuration that are located in spaced parallel disposition within a container and a second set of differently configured panels also located in spaced parallel disposition in a direction generally normal to the disposition of the first set of panels. Each panel includes an intermediate body portion and a plurality of projections extending both upwardly and downwardly therefrom. The projections in each set of panels are laterally staggered so as to form alternating projections and cutouts on either side thereof. Furthermore, slots are provided in each set of panels to facilitate their interconnection. The slots of one of the sets of panels are disposed through each downwardly extending projections thereof. In this manner, the configuration of the resultant cells from the interfitting of respective slots from each panel sets is such that at one side thereof, the projections are disposed through each downwardly extending projection thereof. In this manner, the configuration of the resultant cells from the interfitting of respective slots from each panel sets is such that at one side thereof, the projections are disposed adjacent to each other for maximum lateral protection of articles placed therein (i.e., article base), and at the opposite end thereof the projections are disposed and spaced from each other along the cell periphery to minimize contact between centrally projecting article portions (i.e., article neck).

It is therefore a primary object of the instant invention to provide a partition for a container in which the cell configuration formed thereby is different at each end thereof, so as to provide flexibility in accommodating various shaped articles to be contained therein.

A further object of the present invention is the provision of a partition for a container having sets of panels with transversely offset outwardly extending projections on either side thereof, one such set of panels being provided with a slit through the projections of one side thereof so as to laterally shift the attitude of such projections into adjacent corner contact with each other when the panels are interfitted to form individual article receiving cells.

Still another object of the invention is the provision of a partition for a container wherein the individual panel portions thereof are formed from blank material with a minimum material usage thereof, the panel portions being in a manner to minimize any resultant weakening thereof.

Other objects, features and advantages of the invention will become apparent when the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
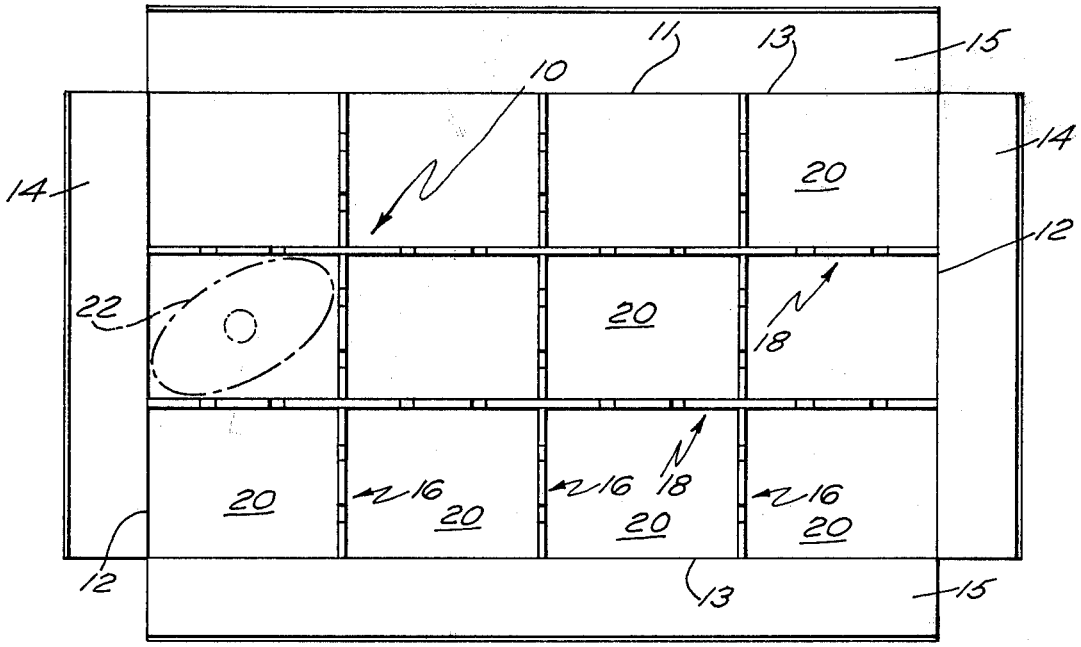
FIG. 1 is a top plan view of the partitioning of the present invention as located in place within a container.

Referring now to the drawing and in particular to FIG. 1, the partitioning of the present invention is generally indicated at 10 and is shown in place within a conventional cardboard container 11, having sidewalls 12 and 13 and closure flaps 14 and 15. The partitioning 10 includes first and second sets of spaced parallel panels 16 and 18, respectively, which are preferably formed of conventional corrugated core paperboard stock. The particular embodiment of the panels 16 and 18 depicted defines individual cells 20 in which articles as illustrated by the narrow neck elliptical base bottle 22 shown in dotted lines are located in separate relation. The partitioning 10 and the adjoining side walls 12 and 13 of the container 11 also serve in a manner which will more clearly be hereinafter brought out to separate each such article 22 from contact with another article located in an adjoining cell. Obviously the number of panels in each set may be varied to provide a desired number of cells.

Figure 2:
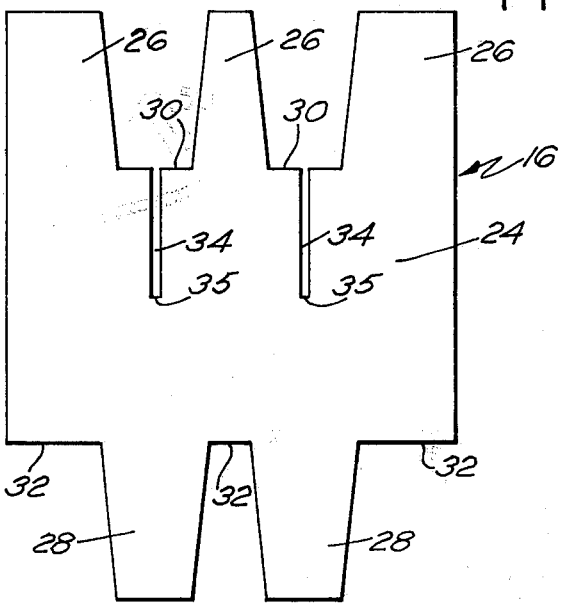
FIG. 2 is a plan view of one of the panels of a first set thereof.
Figure 3:
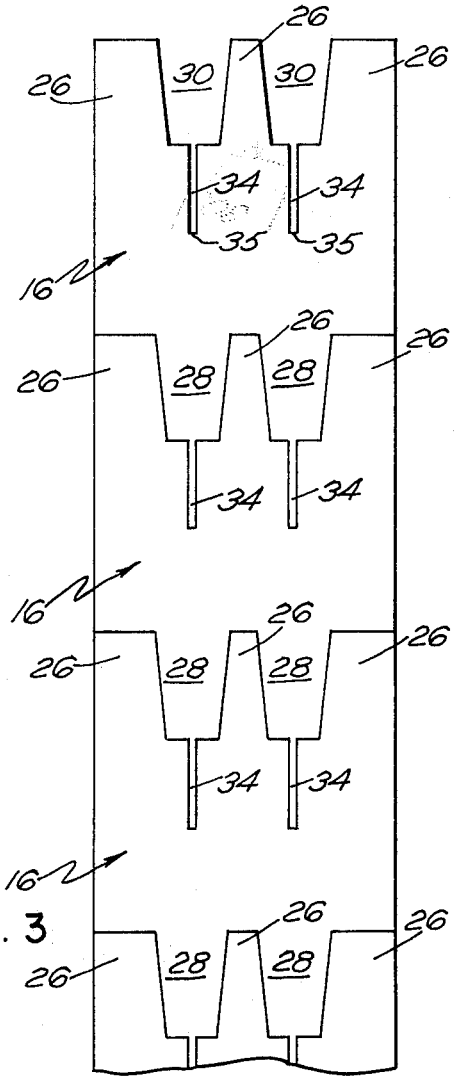
FIG. 3 is a plan view of a blank from which multiple numbers of the panel shown in FIG. 2 may be produced as by die cutting with a minimum of material usage.

Referring to FIGS. 2 and 3 of the drawings, the structure of the panels 16 that define the first set of panels is illustrated. Each panel 16 includes an intermediate body portion 24 having, in turn, a plurality of projections 26 that extend upwardly from one side thereof and a plurality of projections 28 that extend downwardly from the other side thereof. The projections 26 and 28 are laterally offset from one another, and in effect form an alternating projection and cutout configuration on each side thereof. The cutouts on the upper side of each panel 16 are indicated at 30, while the cutouts on the bottom sides thereof are indicated at 32. A downwardly extending vertically oriented slot 34 originating at the base of each cutout 30 projects into the intermediate body portion 24 and terminates at a slot end portion 35 therein. As best illustrated in FIG. 3, a plurality of the first set of panels 16 are formed from a blank generally indicated at 36 as by die cutting, and are cut in a head-to-toe relationship so as to minimize the amount of resultant blank scrap.

Figure 4:
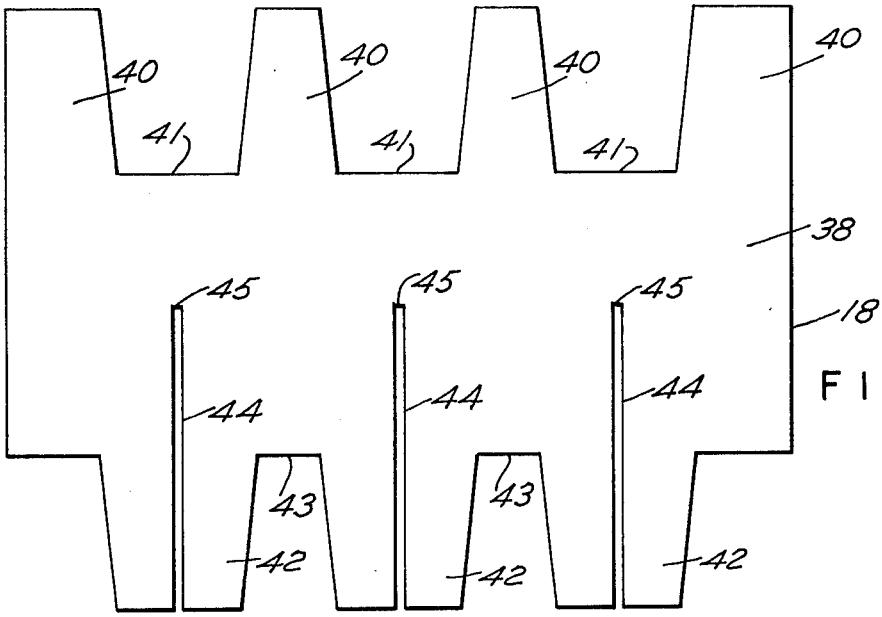
FIG. 4 is a plan view of one of the panels of a second set thereof.
Figure 5:
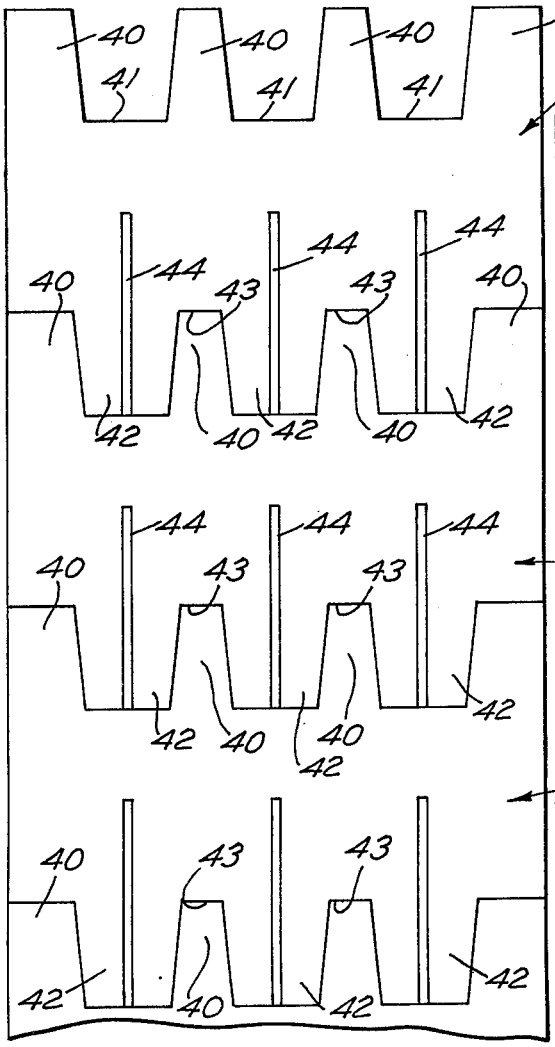
FIG. 5 is a plan view of a blank from which the panels of FIG. 4 are formed.

Referring to FIG. 4 of the drawings, the construction of the panels 18 that define the second set thereof is illustrated; and, as shown, each panel 18 includes an intermediate body portion 38 to which upwardly and downwardly extending projections 40 and 42 are joined. Each set of projections 40 and 42 as joined to the body portion 38 are spaced apart to define cutouts 41 and 43, respectively, the projections on one side of the body portion 38 being laterally offset from the projections on the other side thereof. A slot 44 of vertical orientation extends through each projection 42 and terminates at a slot end 45 in the intermediate body portion 38. The panels 18 are also formed in groups thereof as by die cutting from a blank 46, as shown in FIG. 5, thereby minimizing usage of blank material.

Figure 6:
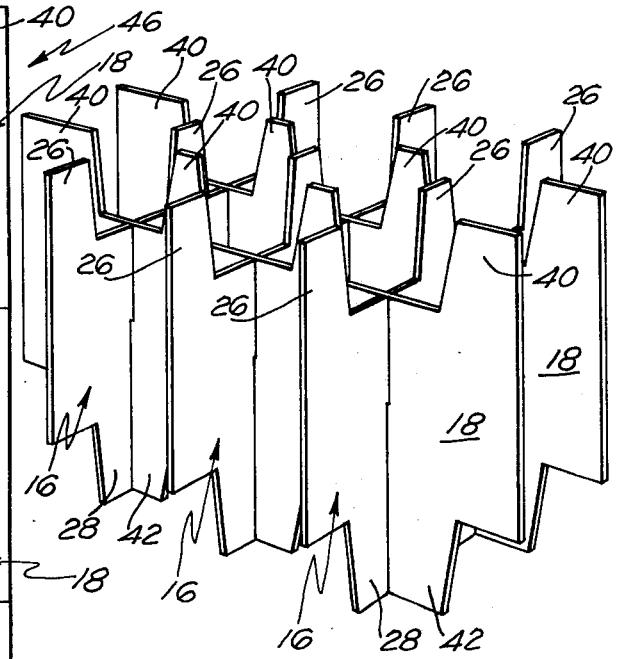
FIG. 6 is a perspective view showing the sets of panels interconnected to form the partitioning of the present invention.

As further illustrated in FIG. 6, respective sets of panels 16 and 18 are arranged transversely and longitudinally of the container 11 so as to form the individual cells 20 in conjunction with the side walls 12 and 13. In the interfitting of the panels, the slots 44 of each panel 18 are aligned with respective slots 34 of a panel 16 and thereafter the slots are fully seated so that the slot ends 35 and 45 of panels 16 and 18, respectively, abut each other. Also as shown in FIG. 6, the downwardly extending projections 28 and 42 of panels 16 and 18, respectively, are located in abutting relationship with respect to each other at the lower end of each cell of those centrally disposed cells, and at least at one corner thereof in those cells which are in part formed by the side walls 12 and 13 of the container 11. This arrangement provides for maximum protection of articles of a generally eliptical basal configuration, such as article 22 depicted in FIG. 1 of the drawings, which assumes a corner-to-corner attitude shown, thus insuring the maximum separation of one article from another in a contiguous cell 20 by providing a maximum amount of material where needed between the articles.

The upper portion of each cell 20 is defined by a plurality of the upwardly extending projections 26 and 40, each of which is positioned intermedially along a peripheral side of each cell 20, and the like projections of which are both spaced and opposed from each other. The upper configuration of each cell as defined by the projections 26 and 40, with material placement at radial mid-points of each cell side, enables maximum protection for articles of a generally cylindrical nature. Thus, coacting projections 26 and 40 serve to either minimize contact between neck portions of articles, or alternatively the entire partitioning 10 may be turned over, that is, reversed in position so that the top portions thereof are presented downwardly so as to best protectively accommodate articles having a generally cylindrical basal cross sectional configuration.

It is thus seen that the partitioning 10 is used to protect articles of various shapes received in the individual cells 20, and that the partitioning has an inherent flexibility to be used in alternate positions not found in prior art constructions, and that such flexibility is in part accomplished by the novel staggered placement of the upwardly and downwardly extending projections of each panel. Furthermore the slot placement either through a downwardly extending projection as in the case of panel 18 or emanating from a cutout opposed to a downwardly extending projection, as in the case of panel 16, provides somewhat greater longitudinal strength in such panels.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A partitioning for a container comprising first and second sets of spaced parallel panels adapted for respective transverse and longitudinal interconnection with each other to delineate a plurality of spaced cells within said container, each panel of said first set of panels having an intermediate body portion and a plurality of projections extending upwardly and downwardly therefrom so as to form alternating projections and cutouts on either side thereof, said upwardly and downwardly extending projections being laterally offset from each other, and a vertically oriented slot extending downwardly from each upper cutout into and terminating in said body portion, each panel of said second set of panels having an intermediate body portion and a plurality of projections extending upwardly and downwardly therefrom so as to form alternating projections and cutouts on either side thereof, said upwardly and downwardly extending projections being laterally offset from each other, and a vertically oriented slot in each of said downwardly extending projections, said slot extending upwardly into and terminating in said body portion, the slots as formed in said first set of panels being located for aligned engagement with slots as formed in said second set of panels.

2. The partitioning of claim 1, wherein downwardly extending projections of each set of panels are located adjacent each other at lower corner locations of said cells.

3. The partitioning of claim 1, wherein upwardly extending projections of each set of panels are located in opposed spaced relation about the upper periphery of each said cell.

4. The partitioning of claim 2, wherein upwardly extending projections of each set of panels are located in opposed spaced relation about the upper periphery of each said cell.

5. The partitioning of claim 1, wherein intermediate body sections of each set of said panels are located adjacent each other thereby enclosing intermediate portions of said cells.

6. The partitioning of claim 2, wherein said panels are locatable alternatively in upward or downward position within said container, so as to dispose said adjacent downwardly extending projections of said cells lowermost or uppermost respectively.

* * * * *